US005191740A

United States Patent [19]

Rose

[11] Patent Number: 5,191,740

[45] Date of Patent: Mar. 9, 1993

[54] APPARATUS FOR CLEANING PIPE

[75] Inventor: James L. Rose, Houston, Tex.

[73] Assignee: E. B. Thomas, Houston, Tex.

[21] Appl. No.: 840,286

[22] Filed: Feb. 24, 1992

Related U.S. Application Data

[63] Continuation of Ser. No. 646,499, Jan. 28, 1991, Pat. No. 5,107,633, which is a continuation-in-part of Ser. No. 470,819, Jan. 26, 1990, abandoned.

[51] Int. Cl.[5] ..... B24C 3/06

[52] U.S. Cl. ..... 51/429; 51/424; 51/425; 51/426; 118/307; 118/326; 118/DIG. 11; 134/175; 134/177; 134/199; 134/200

[58] Field of Search ..... 51/16, 317, 319-321, 51/410-411, 417, 419, 420, 424-426, 428-429; 118/72-73, 305, 308-316, 323, 326, DIG. 11, DIG. 13, 307; 134/144, 151, 153, 157, 163, 172-174, 175, 177, 180-181, 183, 198-200

[56] References Cited

U.S. PATENT DOCUMENTS

| | | | |
|---|---|---|---|
| 1,910,497 | 5/1933 | Peik . | |
| 2,621,446 | 12/1952 | Russell . | |
| 3,362,109 | 1/1968 | Wallace . | |
| 3,994,766 | 11/1976 | Dedels | 118/DIG. 11 X |
| 4,007,705 | 2/1977 | Sherer et al. | 51/411 X |
| 4,205,694 | 6/1980 | Thompson et al. . | |
| 4,237,817 | 12/1980 | Hart et al. | 118/312 X |
| 4,484,559 | 11/1984 | Ledford et al. | 125/1 |
| 4,552,594 | 11/1985 | Van Voskuilen et al. . | |
| 4,595,607 | 6/1986 | Betteridge et al. | 118/316 X |
| 4,603,516 | 8/1986 | Hoffman . | |
| 4,677,998 | 7/1987 | Van Voskuilen et al. . | |
| 4,953,496 | 9/1990 | Taylor et al. . | |
| 5,052,423 | 10/1991 | Chapman et al. . | |
| 5,056,271 | 10/1991 | Rose | 51/429 X |
| 5,069,234 | 12/1991 | Nielsen . | |
| 5,074,323 | 12/1991 | Chapman et al. | 134/181 |
| 5,085,016 | 2/1992 | Rose | 118/305 X |
| 5,091,034 | 2/1992 | Hubert | 51/319 X |
| 5,092,357 | 3/1992 | Chapman et al. | 134/177 X |
| 5,107,633 | 4/1992 | Rose | 51/411 X |

FOREIGN PATENT DOCUMENTS

| | | |
|---|---|---|
| 988403 | 5/1976 | Canada . |
| 1043056 | 11/1978 | Canada . |
| 1080918 | 7/1980 | Canada . |
| 1131418 | 9/1982 | Canada . |
| 1211352 | 9/1986 | Canada . |
| 0214841 | 3/1987 | European Pat. Off. . |
| 0343878 | 11/1989 | European Pat. Off. . |

*Primary Examiner*—Bruce M. Kisliuk
*Assistant Examiner*—John A. Marlott
*Attorney, Agent, or Firm*—Dodge, Bush, Moseley & Riddle

[57] ABSTRACT

A method and apparatus for cleaning the outer periphery of a pipe (10) by a carriage (28) travelling along the pipe (10). A housing (58) supported from an upper support frame (56) of the carriage (28) includes a pair of housing halves (58, 60) pivotally connected to each other and forming an enclosed chamber about the pipe (10). Nozzles (94) on the housing (58) are spaced about the pipe (10) for the discharge of a cleaning material in a high velocity stream against the outer surface of the pipe (10). A lifting head (114) connected to the housing halves (58, 60) pivots the halves (58, 60) to an open position and also lifts the carriage (28) from the pipe (10). An embodiment shown in FIGS. 8-10 includes a housing (58B) mounted on rollers (85B) of carriage frame (56B) for oscillation of housing (58B) and nozzles (94B) in an arcuate stroke relative to the carriage frame (56B).

13 Claims, 7 Drawing Sheets

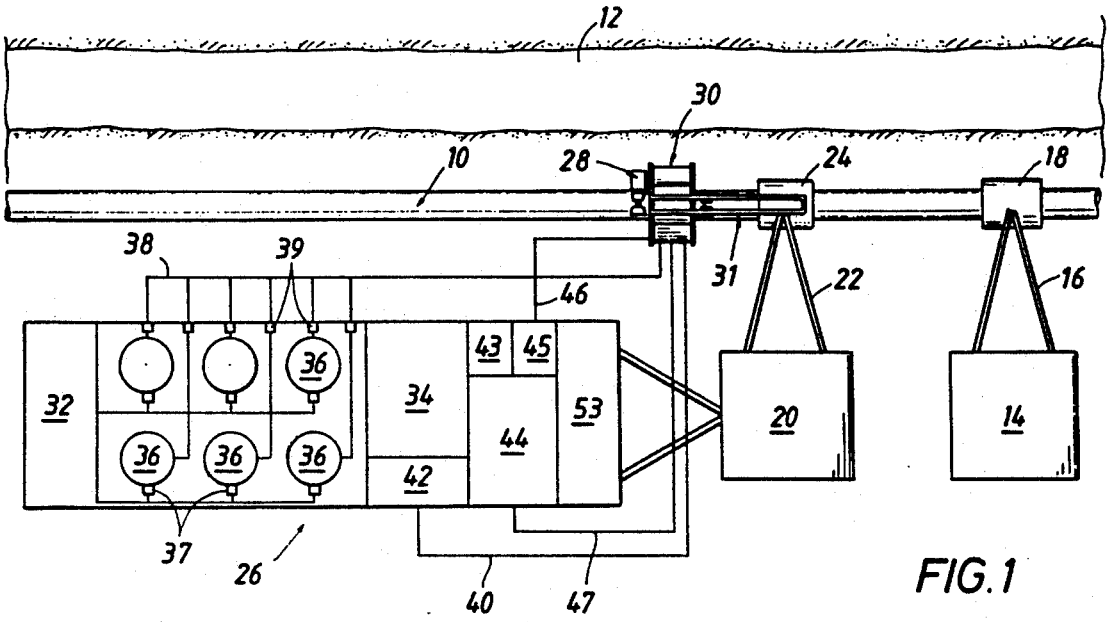
FIG.1
FIG.5
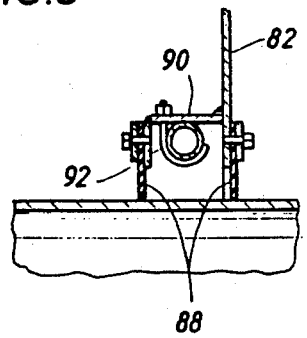
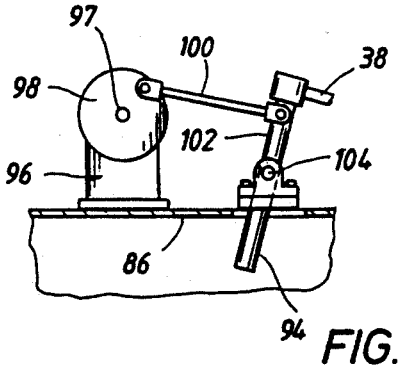
FIG.6
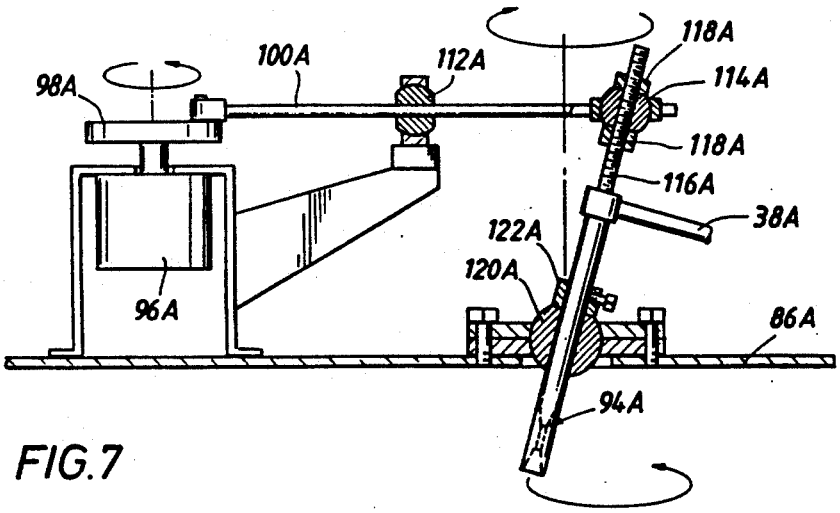
FIG.7

FIG. 14
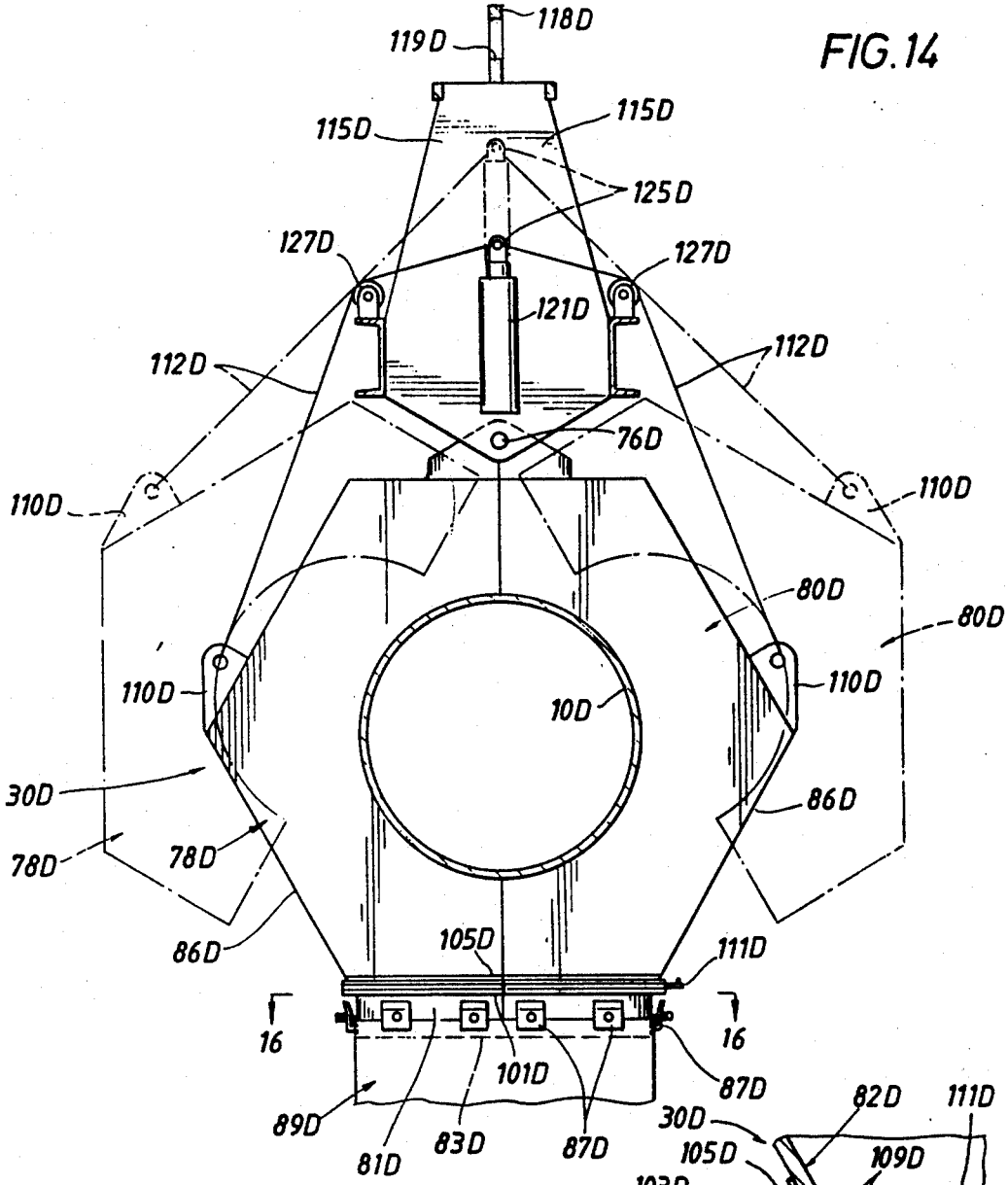
FIG. 16
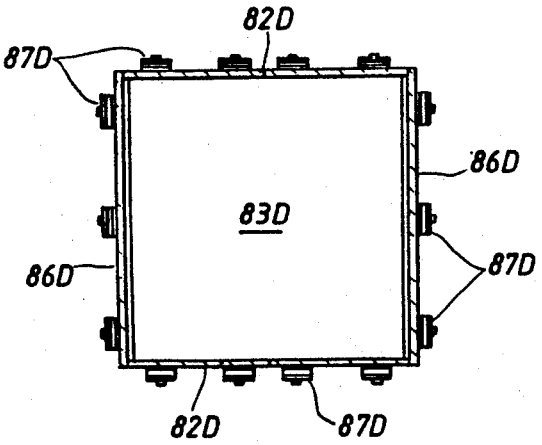
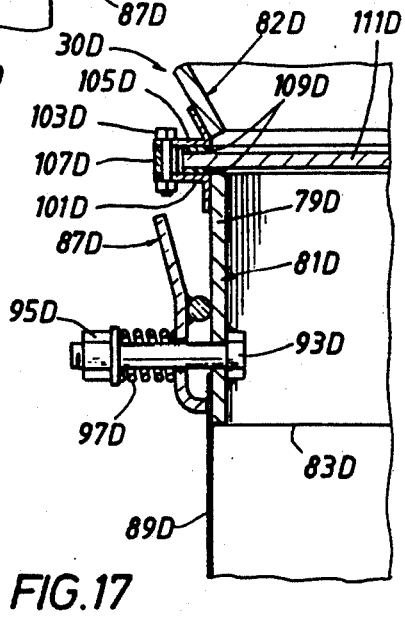
FIG. 17

APPARATUS FOR CLEANING PIPE

REFERENCE TO RELATED APPLICATIONS

This application is a continuation of application Ser. No. 646,499 filed Jan. 28, 1991 now U.S. Pat. No. 5,107,633; which is a continuation-in-part of application Ser. No. 470,819 filed Jan. 26, 1990, now abandoned.

BACKGROUND OF THE INVENTION

This invention relates to the method and apparatus for cleaning pipe, and more particularly to such a method and apparatus for cleaning the outside of the pipe as the apparatus moves along the pipe.

Heretofore, self propelled apparatus has been provided, such as shown in U.S. Pat. No. 4,603,516 for cleaning the outside of pipe as the apparatus moves along a pipeline while supported thereon. Cleaning the outside of pipe removes loose rust, scale and dirt, to prepare the pipe for the subsequent application of a coating material on the outer surface of the pipe to minimize corrosion and prolong the service life of the pipe. In some instances, the pipe may be wrapped with an outer lining material containing an inner coating material for contacting the outer cleaned surface of the pipe. Normally abrasive particles, such as hard shot particles or grit, have been thrown by centrifugal force from an impeller wheel or the like against the outside of the pipe for cleaning the pipe. Particularly where hard shot particles of a uniform size were used previously, a relatively smooth clean outer surface of pipe was provided.

It is desirable to have a roughness on the outer surface of the pipe to provide a strong bond between the pipe and coating. The roughness increases the surface area of the pipe in contact with the coating for "anchoring" the coating on the pipe. Such an increased area bond is particularly needed upon an expansion of the pipe resulting from pressure or temperature increases to maintain the bonding contact between the pipe and coating. The greater the roughness, the stronger the bond between the pipe and coating particularly for shearing stresses. An enclosed blast chamber or housing on a self propelled carriage travelling along the pipe has been utilized previously but such carriages have been relatively complex for carrying blast wheels or impellers and for assembly on and disassembly off the pipe.

Oftentimes, a pipe coating removal device utilizing high pressure water is provided ahead of the so-called de-scaling apparatus so that the pipe coating, such as a bituminous layer, is first removed before the de-scaling operation by a separate cleaning device. For example, as shown in U.S. Pat. No. 4,552,594 dated Nov. 12, 1985, a carriage travelling along a pipeline discharges high pressure water from water jets or nozzles for removal of an outer coating on the pipe. The nozzles are positioned about the pipe for oscillation as the apparatus moves along the pipe thereby to clean the entire outer periphery of the pipe.

An enclosed chamber or housing is normally provided on a travelling carriage of the pipe cleaning apparatus for maintaining the discharge water or grit in an enclosed volume about the pipe. However, the carriages heretofore for supporting the discharge nozzle and the assembly on and disassembly off the pipe have been relatively complex.

It is noted that in some instances a non-uniform cleaning of the pipe has been obtained as the distance of the nozzle to the periphery of the pipe varies substantially throughout the oscillation of the nozzle. Thus, a substantially reduced velocity is obtained at the ends of the arcuate stroke as compared with the center of the stroke.

SUMMARY OF THE INVENTION

The present invention includes a self propelled carriage adapted to be easily assembled on a pipe for movement therealong and for discharging therefrom for removal from the pipe. The carriage includes an upper support frame having front and rear rollers for contacting and supporting the carriage on the pipe for movement along the pipe. An enclosed housing or chamber on the carriage is formed by a pair of body halves mounted on the upper supporting frame and hinged to each other for outward swinging or pivotal movement in an open position for lowering onto the pipe. Upon contact of the upper support frame with the pipe, the two body halves are pivoted downwardly about the pipe and latched with the upper support frame of the carriage supported on the pipe for self propelled movement along the pipe.

The self propelled carriage may be easily removed from the pipe by unlatching the body halves and swinging the body halves to an open position removed from the pipe. Then, the carriage may be lifted by the upper support frame for removal from the pipe.

The apparatus and method of the present invention includes a carriage movable along the pipe and an enclosed chamber or housing about the entire outer periphery of the pipe when assembled about the pipe. Discharge nozzles may be mounted for oscillation in a transverse direction relative to the longitudinal axis of the pipe and are spaced about the periphery of the pipe to cover a predetermined surface area such as, for example, an arcuate area of sixty degrees about the periphery of the pipe. In one embodiment the entire housing forming the enclosed chamber along with nozzles fixedly mounted thereon oscillates back and forth in a direction transversely of the longitudinal axis of the pipe thereby to clean the entire outer periphery of the pipe. The box-like housing is supported for oscillation on rollers supported from the main carriage frame and means oscillate the housing back and forth in a predetermined arcuate path on the rollers such as to provide a back and forth arcuate movement of sixty degrees in each direction, for example. Thus, if six equally spaced nozzles are used, the entire outer periphery of the pipe will be cleaned. The entire periphery of the pipe is cleaned as a result of the oscillation of the entire housing with the nozzles remaining at a constant distance from the periphery of the pipe during the arcuate travel of the housing thereby to provide a constant velocity and uniform cleaning action throughout the arcuate back and forth travel of the enclosed housing.

An additional embodiment of the cleaning apparatus of the invention is directed to an improved nozzle mounting means in which tubular supply members for the pressurized cleaning material are secured between opposed ends of the housing and discharge nozzles are mounted on the tubular supply members. Oscillating means for oscillating the tubular supply members and nozzles thereon is mounted on the outside of the housing.

Other improvement includes power means for pivoting the housing halves to an open position prior to lifting of the self propelled carriage from the pipe and means for receiving the waste material from the cleaning operation for disposal.

It is an object of the present invention to provide a method and apparatus for cleaning the outer periphery of pipe in a uniform cleaning action as the apparatus moves longitudinally along the pipe including an enclosed housing for clamping about the pipe for discharging cleaning material in high velocity streams against the pipe.

It is an object of this invention to provide a carriage for movement along the pipe including an upper support frame having longitudinally spaced rollers for contacting the pipe and a housing suspended from the upper support frame having oscillating discharge nozzles for cleaning material including a pair of housing halves pivotally mounted to each other for removable attachment about the pipe.

It is a further object of this invention to provide a method and apparatus utilizing such a self propelled carriage and housing detachably clamped about the pipe and supporting oscillating cleaning nozzles on tubular supply members mounted between the ends of the housing for back and forth movement relative to the outer periphery of the pipe during movement of the carriage along the pipe for discharging cleaning material in high velocity streams for cleaning the entire outer periphery of the pipe in a uniform cleaning action.

It is another object of this invention to provide an improved lifting structure for the carriage to position the self propelled carriage on the pipe and to remove the self propelled carriage from the pipe.

A further object is to provide an improved waste disposal means to receive the waste material resulting from the cleaning operation for disposal.

It is an additional object of this invention to provide a carriage for movement along a pipe having an upper support frame supported on the pipe and a housing formed of two pivoted halves supported from the upper support frame for oscillation relative to the support frame and to the outer periphery of the pipe.

It is a further object of this invention to provide a carriage for movement along a pipe having an enclosed housing about the pipe supporting a plurality of arcuately spaced discharge nozzles fixed thereon with the housing and nozzles mounted for oscillation in an arcuate path relative to the outer periphery of the pipe for cleaning the pipe.

Other objects, features, and advantages of this invention will become more apparent after referring to the following specification and drawings.

BRIEF DESCRIPTION OF THE FIGURES

FIG. 1 is a schematic of the apparatus of the present invention for cleaning the outer periphery of a pipe including a carriage travelling along the pipe and having an enclosed housing with nozzles for discharging cleaning material in a high velocity stream against the outer periphery of the pipe to clean the pipe;

FIG. 5 is an enlarged section taken along line 5—5 of FIG. 3 and showing means on the housing for sealing against the pipe;

FIG. 6 is an enlarged section taken generally along line 6—6 of FIG. 2 and showing means for oscillating the nozzles for the discharge of cleaning material in a high velocity stream against the outer surface of the pipe;

FIG. 7 is an enlarged view of a modified nozzle arrangement in which a nozzle is mounted for movement in a generally circular path;

FIG. 14 is a side elevation, partly schematic, of a further embodiment of this invention showing power means for moving the housing halves to an open position for removal of the self propelled carriage from the pipe and showing a disposable bag removably mounted on the bottom of the housing to receive the waste material from the cleaning operation;

FIG. 16 is an enlarged section taken generally along line 16—16 of FIG. 14 and showing particularly the bottom of the housing receiving the disposable bag; and FIG. 17 is an enlarged section taken generally along line 17—17 of FIG. 16 and showing particularly a releasable clip for gripping the open upper end of the disposable bag.

DESCRIPTION OF THE INVENTION

Figure 2:
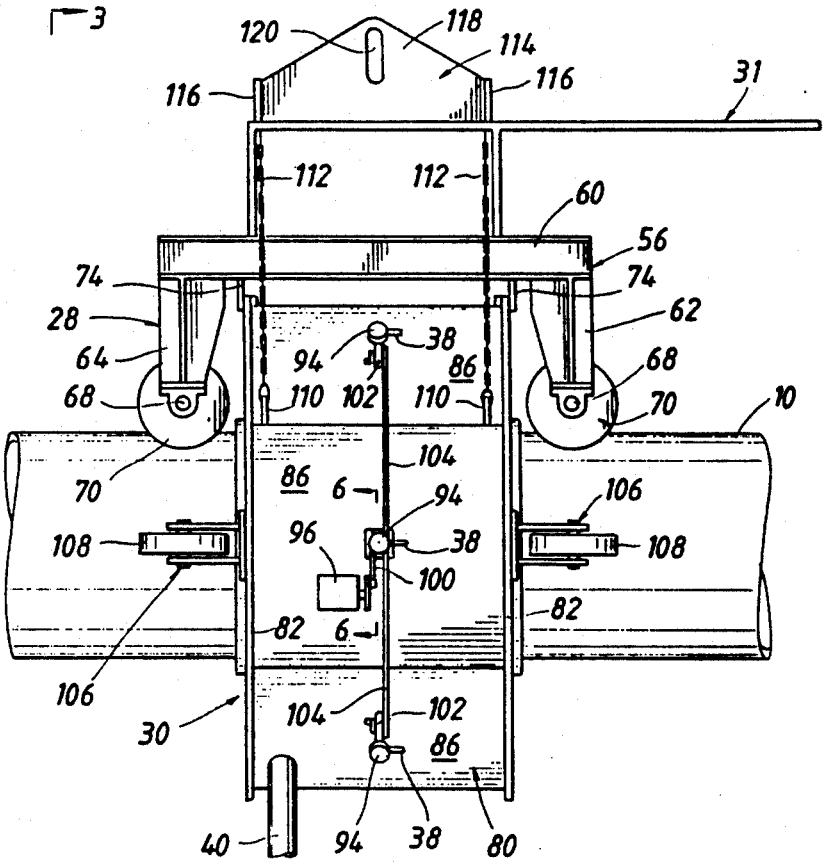
FIG. 2 is a side elevation of a preferred embodiment of the carriage mounted on the pipe and having an upper frame supporting the enclosed housing about the pipe for relative pivotal movement.
Figure 3:
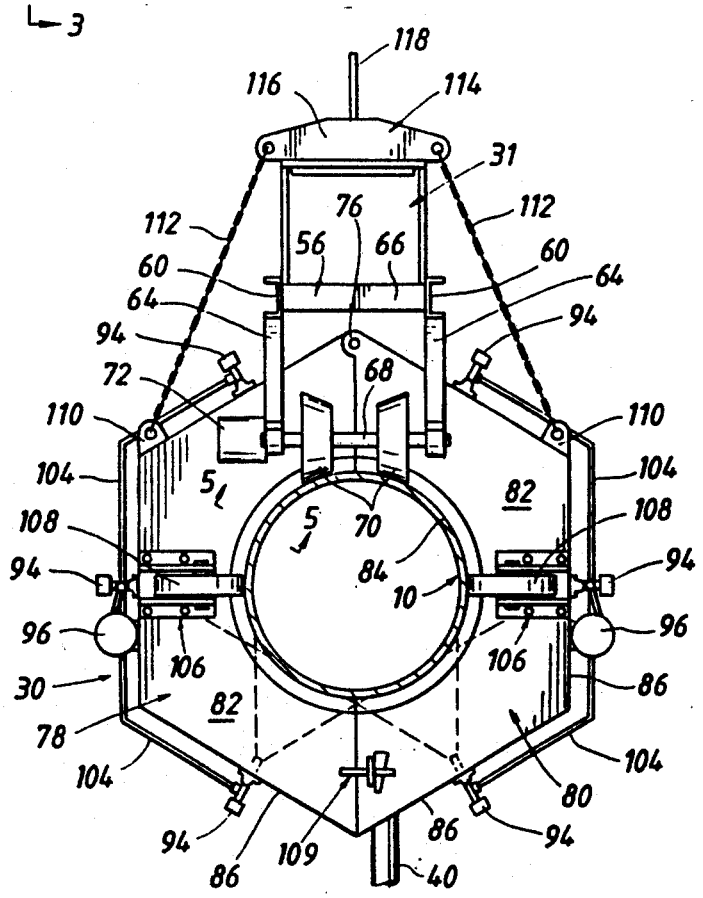
FIG. 3 is an end elevation of the carriage shown in FIG. 2 in position about a pipe for travelling along the pipe and taken generally along line 3—3 of FIG. 2.

Referring now to the drawings for a better understanding of this invention and more particularly to FIG. 1, apparatus for cleaning a pipe in accordance with this invention is illustrated. The pipe or pipeline is shown generally at 10 for cleaning its outer surface of coating material and/or removal of rust scales or the like. Pipe 10 is supported above the ground for cleaning and for coating after being cleaned. Thereafter pipe 10 is placed within a ditch 12 alongside the pipe and covered with soil or gravel. For supporting pipeline 10 above the ground, a front side boom tractor shown at 14 has a side boom 16 supporting a roller pipe support 18 mounted under pipe 10 and having rollers thereon for supporting the lower surface of pipe 10. A rear side boom tractor is shown at 20 having a side boom 22 and a roller pipe support 24 under pipe 10 for supporting the pipe.

Rear tractor 20 pulls a trailer or skid indicated generally at 26 alongside pipe 10 which contains the supplies and power sources for operating a self propelled carriage shown generally at 28 mounted on pipe 10 behind roller support 24. Self propelled carriage 28 includes a housing 30 forming an enclosed chamber about pipe 10 for the discharge of cleaning material against the outside of pipe 10 for cleaning and providing a rough outer finish to pipe 10 for the application of a coating. A frame 31 secured to carriage 28 extends to a position over roller support 24 and is contacted by cable from boom 22 in the event carriage 28 lags behind roller support 24 thereby to maintain carriage 28 at a certain transverse location on pipe 10.

Carriage 28 is adapted for the discharge of cleaning material from discharge nozzles in a high velocity stream for contacting the outer surface of pipe 10. The cleaning material may vary depending on the material to be removed from the outer surface of pipe 10. At times, tar or a bituminous layer may be on the outer surface the pipe and pressurized water may be utilized. In the event rust scales are desired to be removed a grit material is normally discharged in a high velocity stream, such as air, to removed the rust scales and clean the outside of pipe 10. If it is desired to remove rust scales, skid 26 includes an air compressor 32, a grit storage bin 34, a plurality of grit pots or containers 36 each having a separate discharge line 38 for supplying grit entrained in air to a discharge nozzle on housing 30. A hand operated control valve 37 is provided between air compressor 32 and each grit pot 36. An air operated valve 39 is provided in each line 38 adjacent the associated grit pot 36 for control of the supply of grit or abrasive particles to housing 30.

The abrasive particles and removed foreign matter such as rust scales and the like are returned from an opening in the bottom of housing 30 through return line 40 to a cleaner 42 for removal of the foreign matter and return of the abrasive particles to supply bin 34 for recycling. Under certain conditions such as the removal of a coating having asbestos material therein, it may be desirable to have a disposable bag releasably connected beneath an opening at the bottom of the housing to receive the scrap material therein from the cleaning operation. Such an arrangement is shown in the embodiment of FIGS. 14–17 and will be explained further herewith. A hydraulic reservoir is shown at 44 on skid 26 and a hydraulic pump 45 supplies pressurized hydraulic fluid through line 46 to self propelled carriage 28. A suitable diesel engine 43 may be provided for driving hydraulic pump 45. A hydraulic fluid return line 47 is shown for return of fluid to reservoir 44. Skid 26 also includes a control area at 53 for an operator to control the operation including the control of air operated valves 39 and the energizing of hydraulic pump 45.

Now, referring particularly to the embodiment of the invention shown in FIGS. 2–6, carriage 28 includes an upper support frame generally indicated at 56 supporting an enclosed housing generally indicated at 30. Frame 56 has a pair of horizontally extending channel-shaped members 60 arranged in parallel spaced relation to each other. Each horizontal frame members 60 has front and rear legs 62 and 64. A reinforcing member 66 extends between front legs 62 and rear legs 64. A shaft or axle 68 extends between front legs 62 and rear legs 64. Tapered rollers 70 are fixed to axles 68 for contacting the upper surface of pipe 10 and supporting carriage 28 thereon. For driving or propelling carriage 28 along pipe 10 a hydraulic motor 72 is connected to shaft 68 for rotating shaft 68 and associated rollers 70. Motor 72 is preferably connected to front shaft 68 but may, if desired, be connected to rear shaft 68. Hydraulic fluid from pump 45 is supplied to hydraulic motor 72.

A pair of hanger brackets 74 are secured between and extend downwardly from upper frame members 60 supporting enclosed housing 30 for relative movement about pivot axes 76. Housing 30 comprises a pair of housing halves 78 and 80 pivotally connected to each other about pivot axes 76. Housing 30 includes a pair of spaced ends 82 having arcuate openings 84 to receive pipe 10. A peripheral wall formed of six sides 86 extends between and is secured to ends 82 to form an enclosed chamber when in position about pipe 10. Each housing half 78, 80 is generally identical and included three walls or sides 86 connected to each other at 120 degrees thereby to provide a hexagonal shape to housing 30. It is to be understood that the peripheral wall may be formed of any desired number of sides or may be of a cylindrical shape, if desired.

For sealing about pipe 10 and referring particularly to FIG. 5, a pair of annular elastomeric seals 88 adjacent each end wall 88 wipe against the outer surface of pipe 10 as carriage 28 travels along the pipe. An angle 90 is secured to adjacent end wall 82 and seals 88 are secured to angle 90 and end wall 82. A plurality of spaced hangers 94 are mounted on angle 90 to mount a perforated conduit 92 about pipe 10 which is connected to a suitable air source for discharging air from the perforations in conduit 92 against pipe 10. Leading conduit 92 provides an initial cleaning action and trailing conduit 92 tends to remove any deposits of scales or foreign material remaining on pipe 10 after housing 30 has moved over pipe 10. Also, adjustment of seals 88 permits housing 30 to be utilized with pipe 10 of different diameters, such as diameters having a difference as much as around six inches for example.

For the discharge of cleaning material, such as grit entrained in high velocity air stream, a discharge nozzle 94 is mounted within an opening in each side 86 for oscillating movement and has an inner discharge end directed against pipe 10. Housing halves 78, 80 have hydraulic motors 96 mounted thereon with a shaft 97 for each motor 96 connected to an eccentric 98 having links 100 pivotally connected thereon. Links 100 are pivotally connected to nozzles 94 for oscillating nozzles 94 back and forth in a transverse direction. Suitable abrasive grit entrained in high velocity air stream is provided from discharge lines 38 to nozzles 94 with a separate line 38 to each nozzle 94.

Each housing half 78, 80 has on each end 82 thereof a roller bracket 106 secured therein. A roller 108 is mounted for rotation thereon and engages a side of pipe 10. Rollers 108 are mounted for horizontal adjustment to accommodate different diameter pipe 10. A releasably latch indicated generally at 109 is provided to secure housing halves 78, 80 together about pipe 10. A pair of spaced projections or eyes 110 extend upward from each upper side 86 on the edge thereof opposite pivot axes 76. A chain 112 extends between each eye 110 and a lifting frame or head 114 which is supported on frame 31. Lifting head 114 has a pair of parallel ends 116 to which chains 112 are connected. A central connecting web or plate 118 of lift head 114 has a slot 120 therein and a suitable lift hook 121 or the like supported by a cable from boom 22 may be inserted within slot 120 in plate 118 for lifting head 114 and carriage 28 such as shown in FIG. 4.

For assembly of housing 30 on pipe 10, upper frame 28 is first lowered onto pipe 10 with rollers 70 in contact with the upper surface of pipe 10. Then lifting head 114 is lowered onto frame 31 with housing halves 78, 80 pivoting about pivot axes 76 and pipe 10. Latch 109 is latched to releasably secure housing 30 about pipe 10. In this position carriage 28 with housing 30 in latched position is in an operable position.

For operation, an operator supplies hydraulic fluid to hydraulic motors 96 for oscillating nozzles 94. Then, air operated valves 39 are opened by the operator to supply grit in high pressure air streams in lines 38 to nozzles 94 at a pressure of around 100 psi, for example. Hydraulic fluid is supplied to hydraulic motor 72 for propelling carriage 28 along pipe 10. In such manner a predetermined uniform rate of speed along pipe 10 for self propelled carriage 28 of around 950 feet per hour may be provided for a thirty (30) inch diameter pipe. After cleaning of pipe 10, the grit along with rust scales, dirt, paint, coating particles and the like fall to the bottom of housing 30 for return through a suitable opening and vacuum line 40 to grit cleaner 42 for cleaning of the grit as well known in the art. The cleaned grit is returned to grit storage 34 for supply of grit to grit pots 36 for another cycle.

Figure 4:
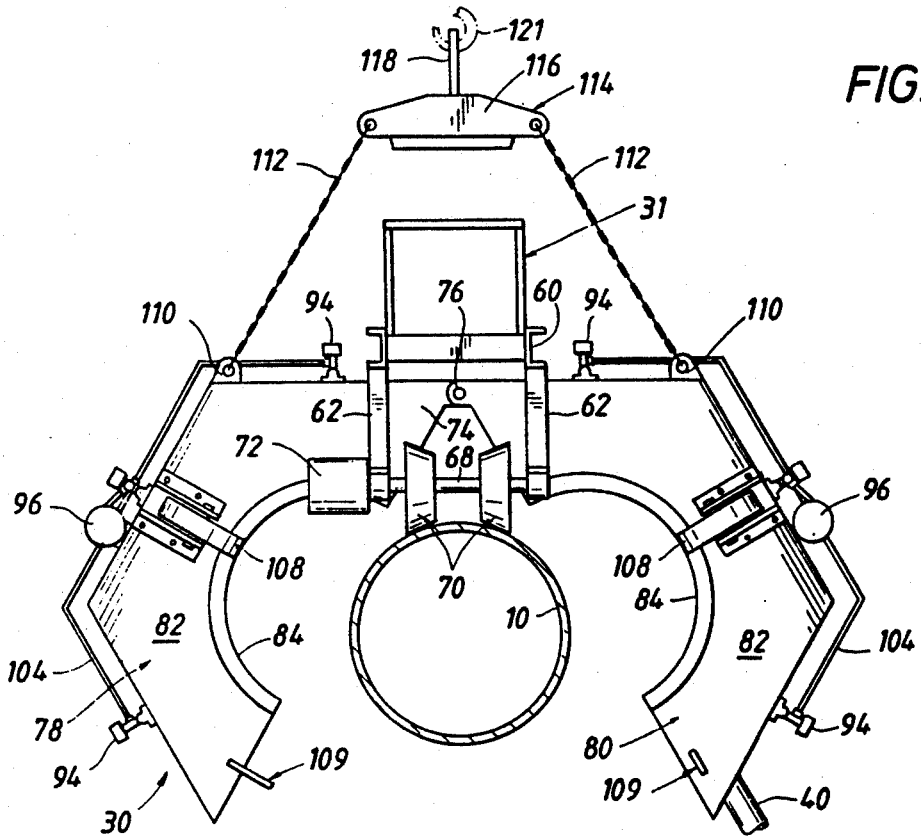
FIG. 4 is an end elevation similar to FIG. 3 but showing the housing halves pivoted to an open position for assembly on and disassembly from the pipe.

For removal of carriage 28 from pipe 10, lift hook 121 is inserted within slot 120 and lifted by a cable from boom 22 after unlatching latch 109 to permit movement of housing halves 78, 80 to an open position as shown in FIG. 4. Upon contact of halves 78, 80 with frame members 60, further lifting of lift head 114 removes carriage 28 from pipe 10.

It is understood that other types of movement may be provided to nozzles 94 in order for nozzles 94 to cover the desired outer surface area of pipe 10 while utilizing a generally uniform diameter orifice. As shown in FIG. 7, a modification of the present invention is shown to add a circular movement to the oscillating movement of the nozzles. Nozzle 94A extends within an opening in side 86A and grit is supplied through line 38A to nozzle 94A for discharge. Hydraulic motor 96A has an eccentric plate 98A and oscillates arm 100A mounted on fixed ball joint 112A and movable ball joint 114A. Externally threaded rod 116A is adjustable on ball joint 114A by adjustment of nuts 118A and nozzles 94A is adjustable on ball joint 120A by sleeve 122A. The oscillating stroke of nozzle 94A may be adjusted by adjustment of ball joint 114A along threaded rod 116A, and by adjustment of nozzle 94A or ball joint 120A. Upon rotation of plate 98A ball 114A of connecting rod 100A moves in a direction to provide an oscillating generally circular motion. For further details of such an arrangement, reference is made to U.S. Pat. No. 5,056,271 dated Oct. 15, 1991.

Under certain conditions, the nozzles may be fixed on housing 30 particularly if a large number of nozzles, such as twelve nozzles, are positioned about pipe 10. When utilizing six nozzles, each nozzle covers an arc of around 60 degrees about the circumference of the pipe.

Figure 8:
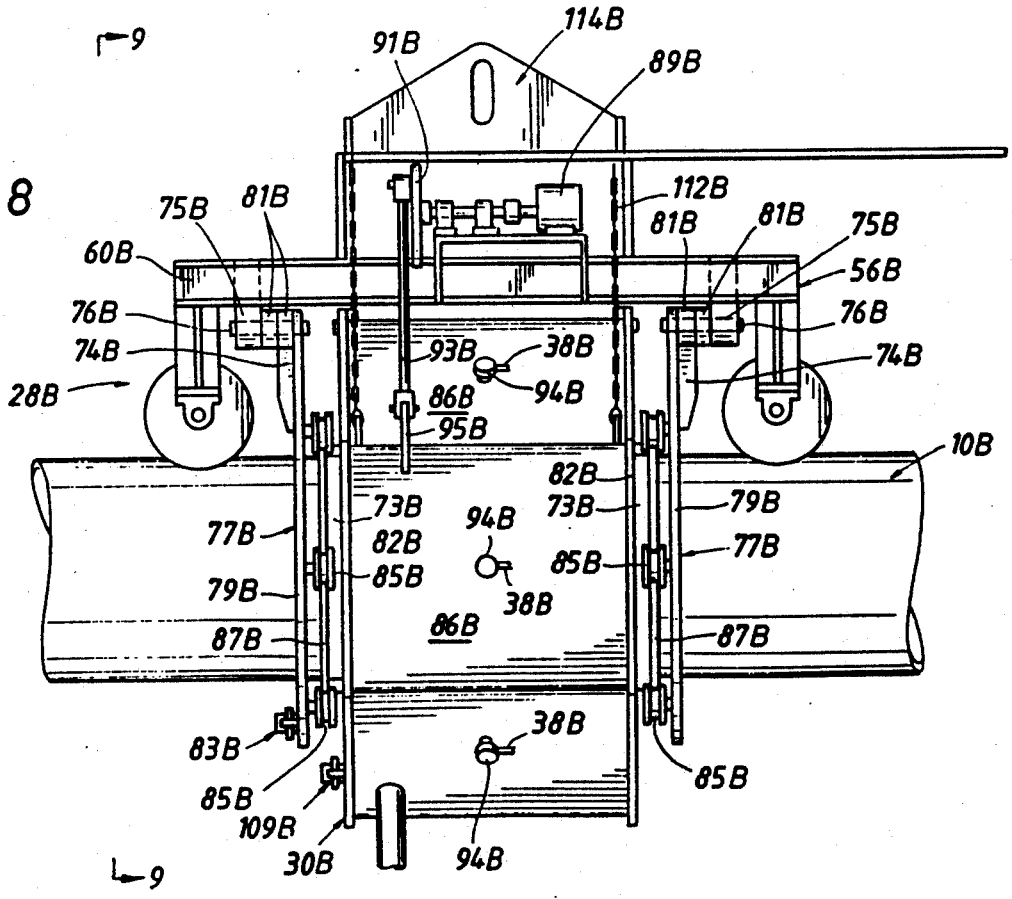
FIG. 8 is a side elevation of a further embodiment of the carriage of this invention in which the enclosed housing and nozzles thereon are mounted for oscillating movement relative to an upper support frame as the carriage travels along the pipe.
Figure 9:
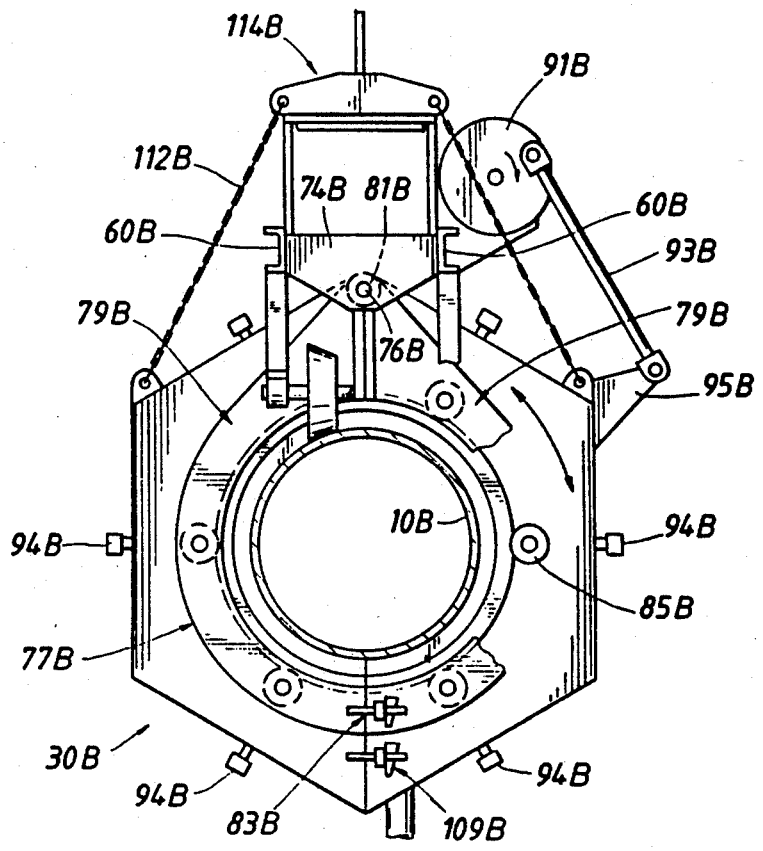
FIG. 9 is an end elevation taken generally along line 9—9 of FIG. 8 with a portion of the supporting frame for the housing being broken away.
Figure 10:
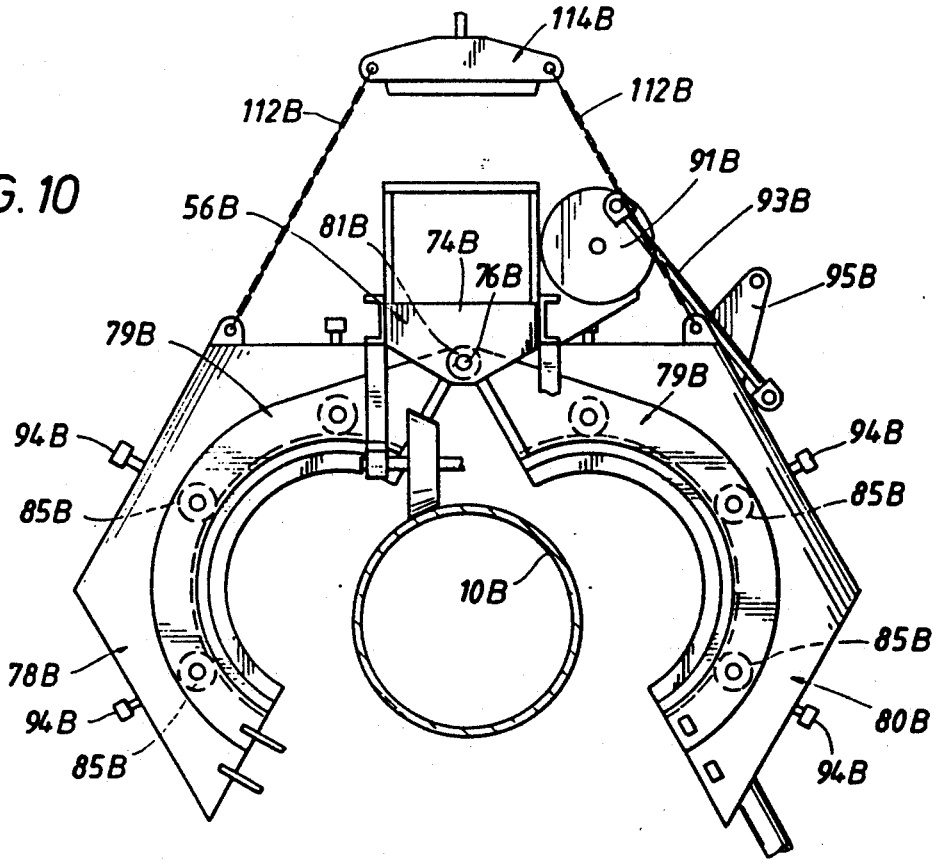
FIG. 10 is an end elevation of the carriage of FIG. 9 but showing the housing and the supporting frame pivoted to an open position for assembly on and disassembly from the pipe.

Referring now to the embodiment shown in FIGS. 8-10, a carriage 28B having an upper support frame 56B supports a separate nozzle housing frame 30B having six fixed nozzles 94B thereon for oscillating movement relative to support frame 56B and mounted at equally spaced arcuate intervals of around sixty degrees about the outer circumference of pipe 10B. Supply lines 38B for the pressurized cleaning material are connected to nozzles 94B for supplying the cleaning material in a pressurized stream. Carriage support frame 56B includes a pair of hanger brackets 74B secured between frame members 60B adjacent opposed ends 82B of housing 30B. Each bearing hanger bracket 74B has a bearing 75B mounting a shaft 76B for rotation. Mounted adjacent each end of housing 30B is an annular housing support member or yoke generally indicated at 77B. Each housing support member 77B includes a pair of complementary semicircular sections 79B each having a bearing 81B receiving shaft 76B to permit sections 79B to pivot about pipe 10B. A latch 83B is provided to secure sections 79B in position about pipe 10B. Each semicircular section 79B has three grooved rollers 85B mounted therein adjacent housing 30B and spaced from each other at an arc of 60 degrees.

Each housing end 82B has an extension 73B with an annular flange 87B thereon adjacent each end 82B of housing halves 78B, 80B. Flanges 87B are received within grooves in rollers 85B to provide longitudinal movement of housing 30B with carriage 28B but permit rotative movement of housing 30B relative to support frame 56B and yokes 77B of carriage 28B. Housing halves 78B and 80B function similarly to housing halves 78, 80 in the embodiment of FIGS. 2-6 and are connected by chains 112B to lifting head 114B for pivoting and lifting.

To oscillate housing 30B and nozzles 94B thereon back and forth through an arcuate travel of around sixty degrees in an arcuate direction concentric to the outer surface of pipe 10B as indicated by the arrow in FIG. 9, for example, a hydraulic motor 89B mounted on carriage frame 56B has an eccentric 91B for movement of link 93B connected between eccentric 91B and a lug 95B secured to a side 86B of housing 30B. Upon supplying fluid to hydraulic motor 89B, housing 30B with fixed nozzles 94B move back and forth on rollers 85B in an arcuate movement relative to carriage frame 30B. Upon pivoting of housing halves 58B, 60B for removal from pipe 10B as shown in FIG. 10, link 93B is disconnected along with latches 83B and 109B.

Figure 11:
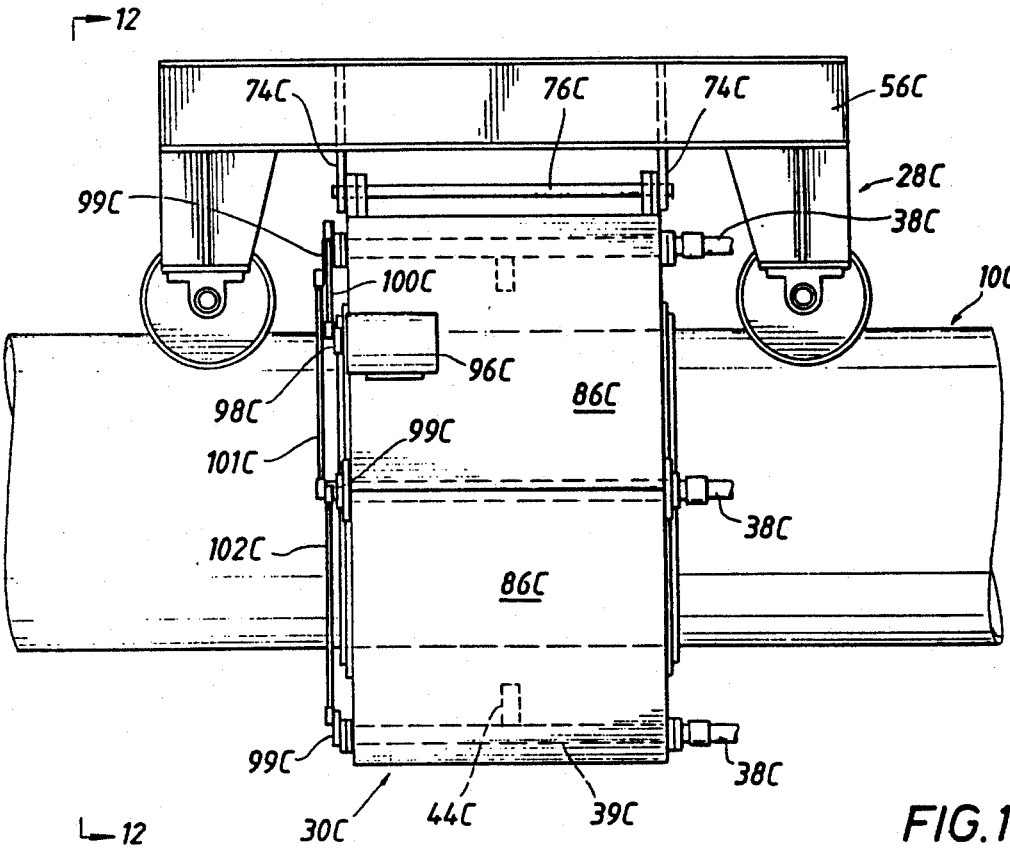
FIG. 11 is a side elevation of a further embodiment of this invention in which the housing supported by the self propelled carriage has tubular supply members for the cleaning material mounted between the ends of the housing with external drive means for oscillating the tubular supply members and nozzles fixed thereto.
Figure 12:
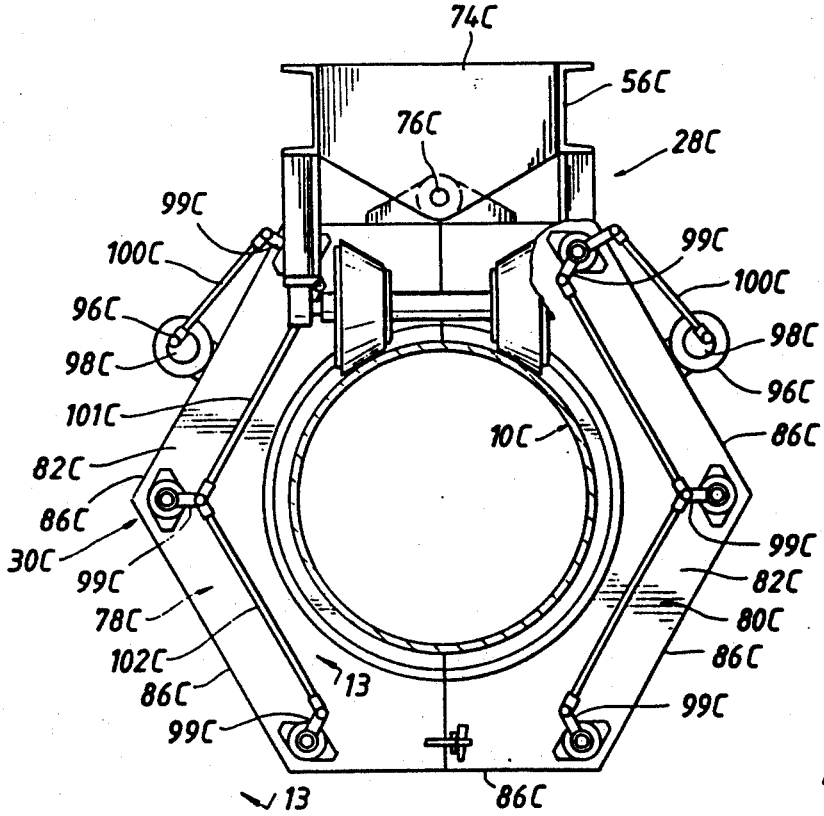
FIG. 12 is an end elevation of the carriage shown in FIG. 11 taken generally along line 12—12 of FIG. 11 and illustrating particularly the drive means for oscillating the tubular supply members.
Figure 13:
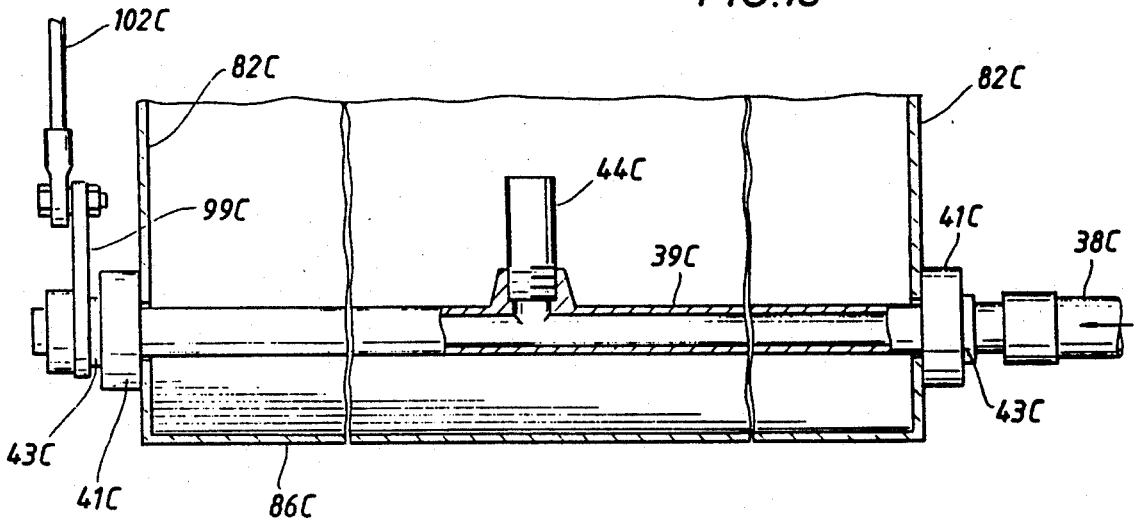
FIG. 13 is an enlarged section taken generally along line 13—13 of FIG. 12 and showing a tubular supply member mounted between the ends of the housing with a discharge nozzle fixed thereto.
Figure 15:
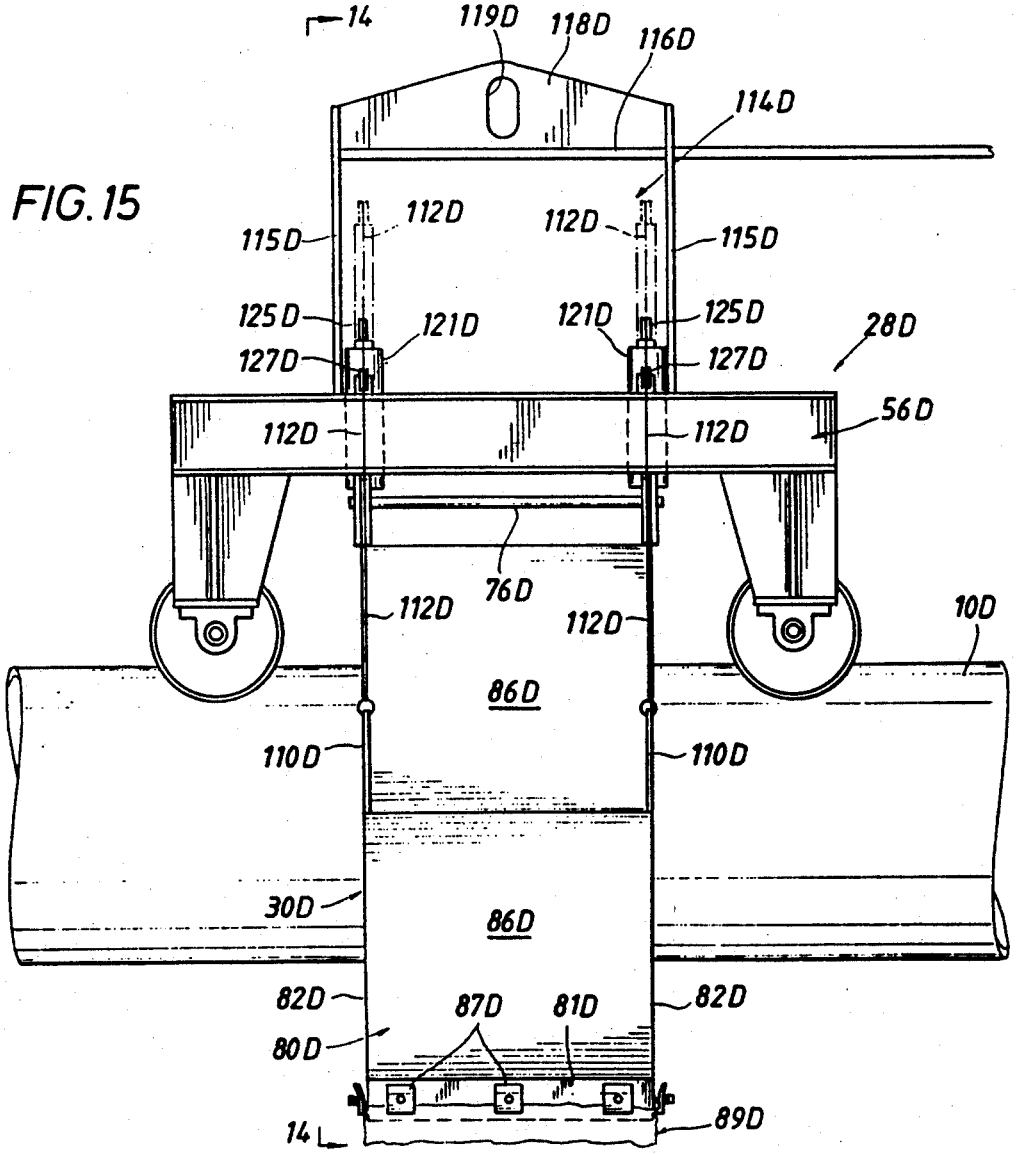
FIG. 15 is a side elevation of the apparatus shown in FIG. 14.

Referring to FIGS. 11-13, a carriage 28C is shown similar to carriage 28 in the embodiment of FIGS. 1-5 except for the mounting and oscillation of the discharge nozzles 94C. Carriage 28C includes an upper support frame 56C mounting housing halves 78C and 80C of housing 30C so that the entire circumference of pipe 10B is subjected to the cleaning action for pivotal movement about shaft 76C on brackets 74C. Housing 30C includes a pair of spaced parallel ends 82C and a peripheral wall formed by six sides 86C extending between ends 82C to provide an enclosed cleaning chamber.

Mounted generally at the juncture at each pair of adjacent sides 86C is a tubular supply member of pipe 39C extending between ends 82C and supported in bearings 41C for relative rotation. An adjustable sleeve 43C adjacent each bearing 41C is secured to supply pipe 39C. Flexible supply line 38C is removably connected to one end of pipe 39C to supply pressurized cleaning material to pipe 39C and discharge nozzle 44C secured thereto. The other end of pipe 39C is closed.

For oscillating nozzles 44C in a transverse direction relative to the longitudinal axis of pipe 10C, a hydraulic motor 96C is mounted on an upper side 86C of each housing half 78C, 80C and rotates an eccentric 98C. Each supply line 39C has a crank arm 99C secured thereto. Link 100C extends between eccentric 98C and crank arm 99C for upper tubular supply pipe 38C. Link 101C extends between eccentric 98C and crank arm 99C for intermediate tubular supply pipe 38C. Link 102C extends between crank arm 99C for intermediate and lower tubular supply pipes 38C. Upon the supply of fluid to hydraulic motors 96C, supply pipes 39C and nozzles 44C secured thereto oscillate in a predetermined arcuate travel such as around fifteen or twenty degrees, for example, to clean a predetermined arcuate surface area of around a sixty degree arc on pipe 10C. Nozzles 44C are positioned completely within the enclosed cleaning chamber defined by housing 30C and no exposed openings are provided in housing 30C for the mounting of nozzles 44C.

Referring now to the embodiment shown in FIGS. 14–17, power means particularly for opening housing halves 78D and 80D of housing 30D and a disposable bag connected to the housing for receiving the waste material from the cleaning operation are shown. Carriage 28D is similar to carriage 28 in the embodiment of FIGS. 1–5 and includes an upper support frame 56D mounting housing halves 78D and 80D for pivotal movement about shaft 76D. A pair of spaced eyes 110D extend from each housing half 78D, 80D. A lifting head 114D includes a pair of spaced end plates 115D secured to support frame 56D. An upper horizontal web 116D extends between plates 115D and a vertical web 118D extends upwardly from web 116D. An eye 119D in vertical web 118D is adapted to receive a lift hook from a crane or the like for removal of carriage 28D from pipe 10D and for positioning carriage 28D on pipe 10D.

A hydraulic cylinder 121D is secured to each plate 115D and has a piston rod 125D. Pulleys 127D are fixed to frame 56D. Cables 112D are secured to piston rod 125D and extend over pulleys 127D to eyes 110D on opposed housing halves 78D, 80D. Thus, upon actuation of hydraulic cylinder 121D to the broken line position shown in FIG. 14, piston rods 125D having cables 112D secured thereto are raised to move cables 112D upwardly to pivot simultaneously housing halves 78D and 80D outwardly in position for lifting of carriage 28D from pipe 10D. The term "cable" as used herein is interpreted as including chains, ropes, cords, belts, and similar flexible members.

Housing 30D is particularly adapted for the removal of coatings from pipe 10D, such as coatings containing an asbestos material for example, that may be harmful to the environment. For this purpose the lower end of housing 30D has a bottom rectangular chute portion generally indicated at 81D with a rectangular body 79D defining an opening 83D between ends 82D and sides 86D. Mounted on body 79D adjacent opening 83D on ends 82D and sides 86D are releasable fastening clips 87D for releasably gripping the sides of a plastic bag indicated at 89D. Each clip 87D is mounted for pivotal movement about axis 98D. A bolt 93D extends through clip 87D and flange 81D. A nut 95D threaded onto the end of bolt 93D compresses spring 97D against clip 87D for tightly clamping bag 89D against body 79D. Upon bag 89D being filled by waste material from the cleaning operation, bag 89D may be released from clips 87D for storage and/or disposal at a preselected waste site. Bag 89D may be positioned, if desired, on an adjacent skid drawn by a tractor.

At times, it may be desirable to close the bottom of housing 30D in the event it is desired to operate carriage 28D without utilizing bag 89D or to isolate bag 89D from the housing chamber. For this purpose, a slidable closure for the bottom of housing 30D may be provided. Rectangular body 79D has an angle 101D connected thereabout and secured by bolts 103D to angle 105D about housing 30D. A spacer 107D spaces angles 101D and 105D from each other to define a slot adjacent spacer 107D. The opposed legs of angles 101D and 105D have a resilient lining material 109D thereon and a slidable plate 111D is mounted for insertion within the slot formed between angles 101D and 105D when it is desired to close opening 83D. When plate 111D is removed from the slot, the entrance opening for removable plate 111D may be suitably sealed.

While the cleaning material has been illustrated as grit, it is to be understood that the present invention may be utilized with other cleaning material in a high velocity stream. For example, pressurized water may be utilized as a cleaning material as might be desirable for removal of a tar or bituminous coating from the outer surface of the pipe. In the event water is used, a water tank and pump are provided on the skid and water hoses from the pump are provided to the nozzles for discharge in high velocity stream against the pipe.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A carriage adapted to be supported on the upper surface of a pipe for longitudinal movement along the pipe to clean the outside of the pipe; said carriage comprising:

an upper support frame having rollers for contact with the pipe to support the carriage thereon for travel along the pipe;

a housing having a pair of spaced ends with aligned openings therein adapted to receive the pipe therein, and an outer peripheral wall extending between said ends about said pipe to form a substantially enclosed chamber with said ends about the periphery of said pipe, said housing being divided into sections for fitting about the pipe and having a discharge opening for waste material from the cleaning operation;

means pivotally connecting said housing sections to each other for inward swinging movement relative to said pipe for assembly about said pipe to define said enclosed chamber about said pipe and for outward swinging movement for disassembly from said pipe;

a plurality of nozzles mounted within said housing between said spaced ends and spaced about the periphery of said pipe for the discharge of cleaning material within the enclosed chamber against the outer periphery of said pipe, said nozzles being mounted on said housing sections for pivotal movement therewith when said housing sections are assembled about said pipe and disassembled from said pipe;

means for moving said nozzles in a predetermined pattern relative to the outer periphery of said pipe for cleaning the outer periphery of said pipe;

collecting means adapted to receive said waste material from said discharge opening; and conduit means between said discharge opening and said collecting means connected to said discharge opening to receive waste material from said cleaning operation.

2. A carriage as set forth in claim 1 wherein said collecting means comprises a skid movable alongside said pipe adjacent said carriage.

3. Apparatus for cleaning the outer surface of a pipe supported above the ground adjacent a ditch and comprising:

a side boom tractor for supporting the pipe above the ground;

a skid pulled by said side boom tractor adjacent a side of the pipe to be cleaned;

a source of cleaning material for said pipe on said skid;

collecting means on said skid for waste material removed from said pipe;

a carriage supported on the upper surface of said pipe for longitudinal movement along the pipe and comprising;

an upper support frame having front and rear rollers thereon for contact with the pipe to support the carriage thereof for travel along the pipe;

a housing supported from said upper support frame between said front and rear rollers and having a pair of spaced ends adjacent said rollers with aligned openings therein adapted to receive the pipe therein, and an outer peripheral wall extending between said ends about said pipe to form a substantially enclosed chamber with said ends about the periphery of said pipe, said housing being divided into sections for fitting about the pipe and having a discharge opening for waste material from the cleaning operation;

means on said upper support frame pivotally connecting said housing sections to each other for inward swinging movement relative to said upper support frame for assembly on said pipe to define said enclosed chamber about said pipe and for outward swinging movement for disassembly from said pipe;

a plurality of nozzles mounted on said housing between said spaced ends and spaced about the periphery of said pipe for the discharge of cleaning material within the enclosed chamber against the outer periphery of said pipe, said nozzles being mounted on said housing sections for pivotal movement therewith when said housing sections are assembled about said pipe and disassembled from said pipe;

means supported from said housing for moving said nozzles in a predetermined pattern relative to the outer periphery of said pipe for cleaning the entire outer periphery of said pipe; and means connected about said discharge opening and extending to said collecting means for the conveyance of waste material from said cleaning operation to said collecting means.

4. Apparatus as set forth in claim 3 wherein a hydraulic fluid reservoir and hydraulic fluid pump are mounted on said skid; and a hydraulic fluid motor in fluid communication with said fluid pump is operatively connected to said nozzles for movement of said nozzles in said predetermined pattern.

5. Apparatus as set forth in claim 4 wherein said hydraulic fluid motor is operatively connected to said nozzles for oscillating said nozzles back and forth in a direction generally transversely of the longitudinal axis of said pipe.

6. A carriage adapted to be supported on the outer surface of a pipe for longitudinal movement along the pipe to clean the outside of the pipe; said carriage comprising:

a housing having a pair of spaced ends with aligned openings therein adapted to receive the pipe therein, and an outer peripheral wall extending between said ends about said pipe to form an enclosed cleaning chamber with said ends about the periphery of said pipe when assembled on said pipe, said housing being divided into two housing sections and having a discharge opening for waste material from the cleaning operation;

means pivotally connecting said housing sections to each other for inward swinging movement relative to said pipe for assembly about the circumference of said pipe and outward swinging movement for disassembly from said pipe;

antifriction means supporting said housing on said pipe for longitudinal movement along the pipe;

collecting means adapted to receive and collect said waste material from said housing;

means for collecting said collecting means about said discharge opening;

a plurality of nozzles within said housing between said spaced ends for the discharge of cleaning material against the outer periphery of said pipe, said nozzles being mounted on said nozzle sections for pivotal movement therewith when said housing sections are assembled about said pipe and disassembled from said pipe; and means for moving said nozzles in a predetermined path relative to said pipe for cleaning the outer periphery of said pipe with the waste material from the cleaning operation being collected by said collecting means.

7. A carriage adapted to be supported on the upper surface of a pipe for longitudinal movement along the pipe to treat the outer surface of the pipe; said carriage comprising:

a support frame having antifriction means thereon for contact with the outer surface of the pipe to support the carriage thereon for travel along the pipe;

a housing supported from said support frame and having a pair of spaced generally parallel ends with an outer peripheral wall extending between said ends to form an enclosed treating chamber with said ends about the periphery of said pipe, said housing having a discharge opening for receiving the treating material and entrained waste material from the enclosed treating chamber after the treating operation and restricting removal of the waste material from the treating chamber except through said discharge opening, said housing having a portion mounted for inward movement toward said pipe for assembly on said pipe and for outward movement away from said pipe for disassembly from said pipe;

a plurality of nozzles mounted for discharge within said housing and spaced at arcuate intervals about the outer surface of the pipe for the discharge of treating material within the housing against the outer surface of said pipe;

means to move said nozzles in a predetermined direction relative to said pipe for treating the entire outer surface of the pipe; and means connected to said discharge opening for the conveyance of the treating material and waste material away from said housing.

8. A carriage as set forth in claim 7 wherein means are provided adjacent said carriage to receive said treating material and entrained waste material from said discharge opening and to separate the waste material from the treating material, and means are provided to return the separated treating material to the nozzles for reuse.

9. A carriage as set forth in claim 7 wherein said nozzles are mounted on said peripheral wall of said housing for the discharge of treating material within the enclosed treating chamber, and means are provided to oscillate said nozzles in a predetermined arcuate stroke.

10. A carriage as set forth in claim 9 wherein means are connected to said housing for oscillating said housing and nozzles thereon relative to said support frame.

11. A carriage as set forth in claim 10 wherein additional rollers are positioned between said support frame and said housing for supporting said housing for oscillating movement relative to said support frame.

12. Apparatus for treating a pipe supported above the ground adjacent a ditch, said apparatus comprising:

a side boom tractor for supporting the pipe above the ground;

a skid pulled by said side boom tractor adjacent a side of the pipe to be treated and having a source of treating material for the pipe thereon;

a carriage adjacent said side boom tractor adapted to be supported on the upper surface of the pipe for movement along the pipe to treat the outer surface of the pipe; said carriage including (a) a support frame having rollers thereon for contact with the upper surface of the pipe to support the carriage thereon for travel along the pipe; (b) a housing supported from said support frame and having a pair of spaced generally parallel ends with an outer peripheral wall extending between said ends to form an enclosed treating chamber with said ends about the periphery of said pipe, said housing having a discharge opening for receiving the treating material and entrained waste from the enclosed treating chamber after the treating operation and restricting removal of the waste material from the treating chamber except through said discharge opening, said housing having a pivotally mounted arcuate portion mounted for inward swinging movement toward said pipe for assembly on said pipe and for outward swinging movement away from said pipe for disassembly from said pipe; (c) a plurality of nozzles mounted within said housing and spaced at arcuate intervals about the outer surface of the pipe for the discharge of pressurized treating material within the housing against the outer surface of said pipe; and (d) means to move said nozzles in a predetermined direction relative to said pipe for treating the entire outer surface of the pipe;

pressurized fluid lines extending between said source of treating material on said skid and said nozzles for the discharge of pressurized treating material in a pressurized stream from said nozzles; and means connected between said discharge opening and said skid for the conveyance of the treating material and waste material from said housing to said skid.

13. Apparatus as set forth in claim 12 wherein means are provided on said skid to separate the waste material from the treating material; and means are provided to return the separated treating material to said pressurized fluid lines for return to said nozzles.

* * * * *